US005283538A

United States Patent [19]

Geisler et al.

[11] Patent Number: 5,283,538

[45] Date of Patent: Feb. 1, 1994

[54] APPARATUS FOR COUPLING MICROWAVE POWER OUT OF A FIRST SPACE INTO A SECOND SPACE

[75] Inventors: Michael Geisler, Wächtersbach; Michael Jung, Kahl; Bernhard Kessler, Hanau-Wolfgang, all of Fed. Rep. of Germany

[73] Assignee: Leybold Aktiengesellschaft, Hanau, Fed. Rep. of Germany

[21] Appl. No.: 27,921

[22] Filed: Mar. 8, 1993

Related U.S. Application Data

[63] Continuation of Ser. No. 795,935, Nov. 15, 1991, abandoned.

[30] Foreign Application Priority Data

Nov. 22, 1990 [DE] Fed. Rep. of Germany ..... 4037090

[51] Int. Cl.[5] ..... H01P 5/00

[52] U.S. Cl. ..... 333/24 R; 315/111.21; 333/230; 333/260

[58] Field of Search ..... 333/24 R, 24 C, 230, 333/236, 245, 260, 99 PL; 315/111.21; 376/123

[56] References Cited

U.S. PATENT DOCUMENTS

| | | | |
|---|---|---|---|
| 2,394,398 | 2/1946 | Mouromtseff et al. | 333/24 R |
| 4,755,345 | 7/1988 | Baity, Jr. et al. | 371/123 |
| 5,173,640 | 12/1992 | Geisler et al. | 315/111.21 |

FOREIGN PATENT DOCUMENTS

| | | |
|---|---|---|
| 1930071 | 2/1970 | Fed. Rep. of Germany . |
| 2716592 | 10/1977 | Fed. Rep. of Germany . |
| 3043693 | 6/1981 | Fed. Rep. of Germany . |
| 263648 | 1/1989 | Fed. Rep. of Germany . |

*Primary Examiner*—Paul Gensler
*Attorney, Agent, or Firm*—Felfe & Lynch

[57] ABSTRACT

The invention relates to a device for coupling microwave power out of a first chamber (21) into a second chamber (22). For this purpose a primary antenna (2) and a secondary antenna (3) are provided, the primary antenna (2) reaching into the first chamber (21), while the secondary antenna (3) reaches into the second chamber (22). Between the first chamber (21) and the second chamber (22) there is provided a dividing wall (20) through which a current-carrying means (11) is brought, which joins together the primary antenna (2) and the secondary antenna (3).

22 Claims, 1 Drawing Sheet

APPARATUS FOR COUPLING MICROWAVE POWER OUT OF A FIRST SPACE INTO A SECOND SPACE

This application is a continuation of application Ser. No. 795,935, filed Nov. 15, 1991, now abandoned. Our U.S. Pat. No. 5,173,640 is directed to related subject matter.

The invention relates to an antenna device for coupling microwave power out of a microwave chamber into a plasma chamber, a gas-tight dividing wall being provided between the microwave chamber and the plasma chamber, through which an antenna leads which reaches both into the microwave chamber and into the plasma chamber.

In the coating of large areas by means of plasma-enhanced chemical vapor deposition, the problem arises of ionizing a gas or gas mixture uniformly over a relatively great area so that a uniform plasma will form. One frequently used method of ionizing the gas or gas mixture consists in introducing microwave energy into the gas. In this case the microwave energy is irradiated from a waveguide or a horn radiator through a quartz window into a plasma chamber. Since the dimensions of the waveguide or horn radiator cannot be arbitrarily increased, the result then is that, if the plasma chamber is substantially larger than the irradiation area of the waveguide or horn radiator, the ionization of the gas or gas mixture will be irregular. The limitation of the size of the waveguide or horn radiator is based essentially on the circumstance that microwaves are propagated quasi-optically. Accordingly, the coupling of microwaves out of a first space into a second space—the plasma chamber—is optical, and therefore an optically transparent medium, a quartz window as a rule, is placed between the two spaces.

Apparatus are already known for coupling microwave power from a first microwave chamber into a second chamber (German DE-A-30 43 693, DE-C-27 16 592, German Democratic Republic DD-A-263 648). In these apparatus, however, no separate lead-throughs are provided in the dividing wall between the two chambers.

Also known is a coupling device for very short electromagnetic waves, which has a coupling loop to which a rectifier disposed in the coupling device is connected (German DE-B-19 30 071). This coupling device, however, is usable only as a coupling probe in microwave resonators, waveguides or coaxial lines, but not for the transmission of electromagnetic power out of a first space into a second space.

Furthermore, an antenna is known with which microwave energy can be introduced into a container in which there is a plasma U.S. Pat. No. 4,755,345). This antenna has an inductive and microwave radiating element whose length is shorter than a half wavelength of the microwave, and which reaches into the plasma. The feeding of the radiating element, however, is performed through a conventional coaxial line.

The invention is addressed to the problem of creating an apparatus for coupling great microwave power out of a first space into a second space, in which an optically transparent medium between the two spaces is not necessary, and in which overheating and undesirable coating of the coupling device is prevented.

This problem is solved in accordance with the features of claim 1.

The advantage achieved with the invention consists especially in the fact that the antenna lead-through laid through the dividing wall is suitable for great microwave power levels. Since no magnetic materials are used, this antenna lead-through has but little inherent heating. It is moreover freely dimensionable, so that it can be optimized from the microwave technology viewpoint, i.e., the inside and outside diameters of the lead-through can be selected within broad limits. The thermal conductivity of the antenna lead-through is so great that destruction in practical operation is not possible. The transmitting antenna on the plasma side is so configured that contamination of the insulator and the ignition of a discharge in its vicinity is prevented. Thus any maintenance of a non-independent discharge in the isolation gap becomes interrupted. Furthermore, the gaps between the inner part and outer part of the lead-through are of such dimensions that even an independent discharge within a broader range of pressures cannot exist, for these gaps maintain the dark-space distance. The invention furthermore permits using silver, copper and aluminum as electrode material.

Embodiments of the invention are represented in the drawing and are further described below.

Figure 1:
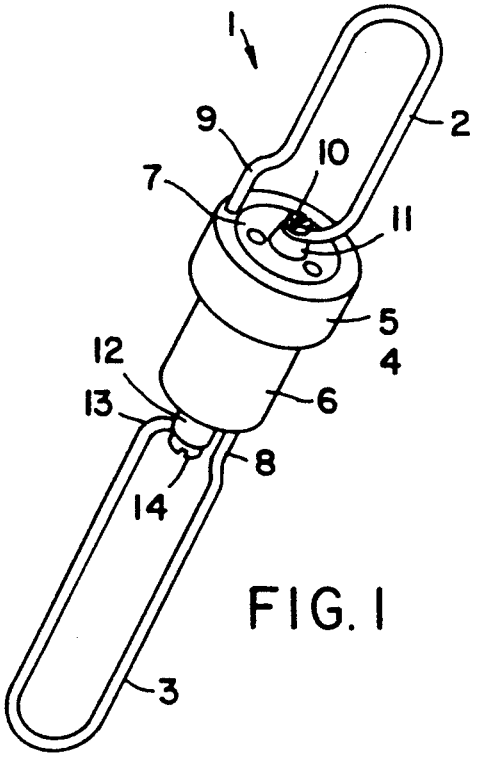
FIG. 1 is a perspective view of a coupling element.

In FIG. 1 there is shown a coupling element 1 according to the invention, which has a primary antenna 2 and a secondary antenna 3 which consist of an electrically conductive material. Between the two antennas is a bushing 4 which has an upper part 5 of large outside diameter and a lower part 6 of small outside diameter. The upper bushing 5 is closed by a threaded plug 7 whose male thread engages a female thread in part 5 of the bushing 4.

The primary antenna 2 and the secondary antenna 3 have the shape of an open loop, one end 8 and 9 of each loop being joined to the bushing 4. The other end of the loop of the primary antenna 2 is connected by a metal screw 10 to one end of the center electrode 11, while the other end of this center electrode 11 is connected with a metal dark-space cap 12, of copper, silver or aluminum for example, to which the other end 13 of the secondary antenna 3 is connected. A dark-space cap is a cap of the length of a dark-space. The connection between dark-space cap 12, secondary antenna 3 and center electrode 11 is made through a screw 14.

The coupling element 1 depicted in FIG. 1 can be inserted singly or together with a plurality of similar coupling elements into a dividing wall between a plasma chamber and a microwave chamber.

Figure 2:
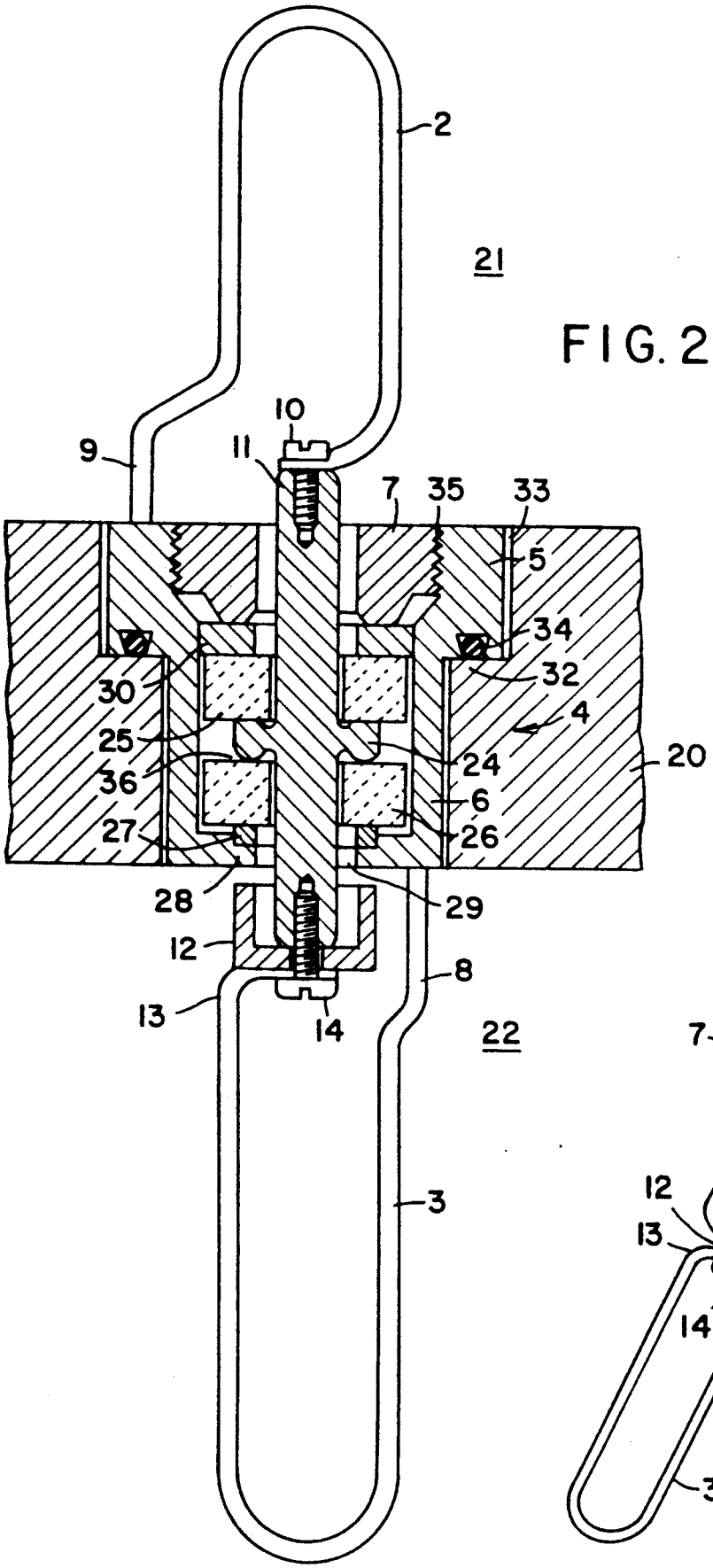
FIG. 2 is a section through a coupling element.

In FIG. 2, the coupling element 1 of FIG. 1 is again shown in section, this coupling element 1 being inserted into a metal dividing wall 20. Above the dividing wall 20, i.e., in the space 21, is air, for example, while in space 22 underneath the dividing wall 20 plasma is present. Into the space 21, which is, for example, a cavity resonator, a microwave is propagated, preferably as a standing wave. From this standing wave, microwave energy is coupled out by the primary antenna 2 and coupled into the plasma of space 22 through the secondary antenna.

The two antennas 2 and 3 are connected to one another by a center electrode 11 consisting of electrically conductive material, which is in the shape of a pin which has approximately in its middle a collar 24. Above and below this collar 24 there is a ceramic disk 25, 26, the lower ceramic disk 26 abutting via a gasket 27 against the bottom 28 of bushing 4, which has an opening 29.

Above the upper ceramic disk 25, which consists of $Al_2O_3$ or AlSin 99.7, there is provided a compression disk 30 of beryllium copper above which there is a threaded plug 7 which with its male thread 35 engages the female thread of the upper part 5 of the bushing 4. The upper part 5 of the bushing is held on a shoulder 32 of a through-bore 33 in the dividing wall 20, through an elastomer gasket 34. The ceramic disk 25 serves for the transmission of force and for electrical insulation between the center electrode 11 and the compression disk 30. The collar 24 on the center electrode 11, which consists of soft metal, e.g., silver, copper or aluminum, is pressed into the substantially harder surface of the ceramic disk 26, which results in a very intense surface contact between the collar 24 of the center electrode 11 and the ceramic disk 26. A corresponding process takes place between the metal gasket 27 and the ceramic disk 26. The seal against the bottom 28 of the bushing is accomplished by the pressing of the metal of the gasket 27 against the metal of the bushing 5. By such joints, sealing systems can be made with a leakage rate decidedly less than $1.0 \cdot 10^{-8}$ mbar·l·s$^{-1}$ for helium.

The pressing force acting on the compression disk 30 is applied with the threaded plug 7. For this purpose the compression disk 30, whose outside diameter is oversize in comparison to the bottom of the threaded plug 7 is first pressed in with a tool. If the threaded plug 7, consisting for example of $V_2A$ steel or copper, is turned further, the combination of metal disk 30, bottom ceramic disk 26, collar 24 of the center electrode 11, upper ceramic disk 25 and compression disk 30 is compressed. As the tightening torque on the threaded plug 7 further increases, the deformation first takes place at the sealing edge 36 of collar 24 on the center electrode 11. Upon further tightening, the metal gasket 27 also deforms. The surface stresses in the packet of metal gasket 27, lower ceramic disk 26, center electrode 11, upper ceramic disk 25 and compression disk 30 are designed such that only at the sealing surfaces does a deformation of the metal surfaces take place in the described order.

As ceramic disks 25 and 26, disks of $Al_2O_3$ or AlSin 99.7 are preferably used, which have a thermal conductivity $\lambda$ that is about ten times less than the thermal conductivity $\lambda$ of the center electrode 11. In order to assure a reliable removal of the amount of heat which the cross section of the center electrode 11 of metal can transfer, a correspondingly large area on the ceramic disk 25, 26, must be used for the thermal transfer. This area is made available by the collar 24 of the center electrode 11, since the top and bottom of the collar 24 are in good, broad contact with the ceramic disks 25, 26.

The removal of heat above and below the ceramic disks 25 and 26 is performed on the one side by the compression disk 30 and on the other side by the metal gasket 27. The compensation of the slightly different thermal expansion properties of the materials of the sealing electrode 11 and the sealing rings 30, 25, 26, 27, on the one hand and of the material of the bushing 4 on the other is established by the ratio between the thickness of the collar 24 of the center electrode 11 and the thickness of the ceramic disks 25 and 26. Any possible shifting of the sealing surfaces against one another due to different thermal expansion of the ceramic-to-metal junction is prevented by this pronounced toothing combined with high pressing forces acting on these surfaces. The compression disk 30 can also be configured as a spring element, of beryllium copper, for example, in order to assure the tightening forces even after considerable thermal overloading of the coupler 1.

The outside diameter of the compression disk 30 increases due to the pressure application. Thus, a secure contact and a contact that is practical from the viewpoint of microwave technology is produced between the outer margin of the compression disk 30 and the inside wall of the bushing 4. The compression disk 30 therefore serves from the microwave viewpoint as the bottom of the bushing 4. The elastomeric seal 34 produced by the sealing of the coupling element 1 against the dividing wall 20 is shielded by a metal envelope formed of a sealing groove on the bushing 5 and a sealing surface 32 and thus protected against destruction. At the same time this metal contact of the bushing 5, urged by screwing, serves for the transfer of heat.

The inside and outside diameter of the coaxial lead-through through the dividing wall 20 can be varied within wide limits by the coupling element according to the invention. For example, the diameter of the center electrode 11, its collar 24, the diameter of the ceramic disks 25, 26, the bores in the threaded plug 31 or in the bottom of the bushing 4 can be selected such that a wave impedance can be associated with the coaxial lead-through. The electrical length of the coaxial lead-through amounts preferably to $\lambda/2$.

The dark-space cap 12 consists of metallic material, e.g., Cu, CuBe, Al, $V_2A$, silver, or the like, and is so shaped that it prevents any penetration of charge carriers from the plasma into the isolation gap of the coaxial lead-through. It is about twice as large as the diameter of the center electrode. Thus the maintenance of a non-independent discharge in the isolation gap is prevented. Also, the gaps between the coupling element 1 and the dividing wall 20 are so dimensioned by maintaining the dark-space distance that even an independent discharge within a wide range of pressure cannot exist. The dark-space cap 12 also lastingly prevents coating or contamination of the insulating disk 26. The upper part 5 and lower part 6 of the coupling element 1 can easily be cleaned by mechanical cleaning methods, e.g., by brushing, by blasting with glass beads, etc. The cup shape or bell shape of the dark-space cap 12 has also proven desirable from the microwave technology viewpoint.

Both the primary antenna 2 and the secondary antenna 3 can be configured as H loops with $1/\lambda << 1$ and as ring antennas or folded dipole antennas with $1/\lambda \approx > 1$, or also as capacitive coupling pins. Preferably the antennas 2 and 3 are configured as ring antennas. At the same time both the ascending and the descending part of the antennas are to have no great bends and are to be as parallel as possible area-wise. The feet of the antennas 2 and 3 can be screwed, soldered, welded or clamped. Radii and lengths, i.e., the geometry of the antennas 2 and 3, are selected such that, in the area of the dark-space cap 12 and to a great extent also in the adjoining part of the coupling element 1 the tensions on the antennas and on the center electrode 11 are low.

The coupling attenuation between the cavity resonator symbolized by the space 21 and a PCVD reactor symbolized by the space 22 can be determined by the size of the primary antenna 2 or also by its orientation relative to the axis of the cavity resonator.

We claim:

1. An antenna device for coupling microwave power out of a microwave chamber into a plasma chamber, a gas-tight dividing wall having a thickness being provided between the microwave chamber and the plasma chamber, through which the antenna device is guided, which reaches both into the microwave chamber and into the plasma chamber, comprising:

a) a primary antenna having a first terminal and a second terminal, said primary antenna being completely located in said microwave chamber;

b) a secondary antenna having a first terminal and a second terminal, said secondary antenna being completely located in said plasma chamber;

c) an antenna lead-through having a middle electrode and an outer electrode, said outer electrode being completely surrounded over its outer surface by said dividing wall and said middle electrode having substantially a length equal to the thickness of said dividing wall;

d) an electrically conductive connection between the first terminal of the primary antenna situated in the microwave chamber and a portion of the outer electrode which is directed at the microwave chamber;

e) an electrically conductive connection between the second terminal of the primary antenna situated in the microwave chamber and a portion of the middle electrode which is directed at the microwave chamber;

f) an electrically conductive connection between the first terminal of the secondary antenna situated in the plasma chamber and a portion of the outer electrode which is directed at the plasma chamber; and g) an electrically conductive connection between the second terminal of the secondary antenna situated in the plasma chamber and a portion of the middle electrode which is directed at the plasma chamber.

2. An antenna device according to claim 1, which includes ceramic disks and a ring-shaped collar all within the portion of the outer electrode which is directed at the plasma chamber and in which the middle electrode has the ring-shaped collar as a portion thereof extending outwardly therefrom, the collar being pressed between the ceramic disks.

3. An antenna device according to claim 2, which includes a metal gasket between one of said ceramic disks facing the plasma chamber and a constriction of the outer electrode.

4. An antenna device according to claim 1, which includes a dark space cap and in which the middle electrode (11) reaches beyond the dividing wall (20) into the plasma chamber (22), and in which a portion of the middle electrode (11) that reaches into the plasma chamber (22) is surrounded by the dark-space cap (12) which prevents the advancement of charge carriers from the plasma chamber to the middle electrode.

5. An antenna device according to claim 4, in which the dark-space cap (12) is in the shape of a cylindrical beaker, an open side of the beaker being directed at the dividing wall (20), while a bottom of the beaker is mechanically connected with an end of the middle electrode (11) that reaches into the plasma chamber (22).

6. An antenna device according to claim 1, in which the outer electrode (5, 6) is a hollow sleeve whose portion (5) directed at the microwave chamber (21) has a greater diameter than the portion (6) directed at the plasma chamber (22).

7. An antenna device according to claim 6, which includes two ceramic disks (25, 26), one compression disk (30) and one annular lock nut (7) contained in the hollow outer electrode (5, 6).

8. An antenna device according to claim 7 which includes a metal gasket and in which the lock nut has an external thread which engages an internal thread of the portion of the outer electrode aimed at the microwave chamber, in which a bottom side of this lock nut rests on the compression disk which rests on a top side of a first one of said ceramic disks having a bottom side in contact with a top side of a collar of the middle electrode having a bottom side in contact with a top side of a second one of said ceramic disks, and in which a bottom side of the second one of said ceramic disks rests on the metal gasket which seals off an interior of the outer electrode from the plasma chamber.

9. Apparatus according to claim 7, in which the ceramic disks consist of $Al_2O_3$.

10. An antenna device according to claim 1, in which the middle electrode (11) is in the form of a pin reaching with its ends into the microwave chamber (21) and into the plasma chamber (22).

11. Apparatus according to claim 1, in which the dividing wall (20) has a recess for the accommodation of the outer electrode (5, 6), this recess having an indentation (32) on which the outer electrode (5, 6) rests, and which includes an elastomeric sealing ring (34) provided between the outer electrode (5, 6) and the indentation (32).

12. An antenna device for coupling microwave power out of a microwave chamber into a plasma chamber comprising;

a) a gas-tight dividing wall between said microwave chamber and said plasma chamber;

b) a primary antenna in said microwave chamber;

c) a secondary antenna in said plasma chamber;

d) coupling means for electrically coupling said primary antenna to said secondary antenna, said coupling means having a rod-like inner portion and a sleeve-like outer portion, said outer portion coaxially surrounding said inner portion, characterized by e) a heat conducting means being connected to said inner portion and having a diameter greater than the diameter of said inner portion;

f) two electrically insulating but heat conducting means, said electrically insulating but heat conducting means enclosing and being in touch with said heat conducting means and extending substantially from said rod-like inner portion toward said sleeve-like outer portion.

13. An antenna device according to claim 12, in which said heat-conducting means comprise ceramic disks and a ring-shaped collar and in which the ring-shaped collar is pressed broadly between the ceramic disks.

14. An antenna device according to claim 13, which includes two ceramic disks (25, 26), one compression disk (30) and one annular lock nut (7) contained in the hollow outer portion (5).

15. An antenna device according to claim 14 which includes a metal gasket and in which the lock nut has an external thread which engages an internal thread of the outer portion aimed at the microwave chamber, in which a bottom side of this lock nut rests on the compression disk which rests on a top side of a first one of said ceramic disks having a bottom side in contact with a top side of a collar of the inner portion having a bottom side in contact with a top side of a second one of said ceramic disks, and in which a bottom side of the second one of said ceramic disks rests on the metal gasket which seals off an interior of the outer portion from the plasma chamber.

16. An antenna device according to claim 13, which includes a metal gasket between one of said ceramic disks facing the plasma chamber and a constriction of the outer portion.

17. Apparatus according to claim 13, in which the ceramic disks (25, 26) consist of $Al_2O_3$.

18. An antenna device according to claim 12, which includes a dark space cap and in which the inner portion reaches beyond the dividing wall into the plasma chamber, and in which a portion of the inner portion that reaches into the plasma chamber is surrounded by the dark-space cap which prevents the advancement of charge carriers from the plasma chamber to the inner portion.

19. An antenna device according to claim 18, in which the dark-space cap (12) is in the shape of a cylindrical beaker, an open side of the beaker being directed at the dividing wall (20), while a bottom of the beaker is mechanically connected with an end portion of the inner portion (11) that reaches into the plasma chamber (22).

20. An antenna device according to claim 12, in which the outer portion is a hollow sleeve whose portion directed at the microwave chamber has a greater diameter than a portion directed at the plasma chamber.

21. An antenna device according to claim 12, in which the inner portion is in the form of a pin reaching with its ends into the microwave chamber and into the plasma chamber.

22. Apparatus according to claim 12, in which the dividing wall has a recess for the accommodation of the outer portion, this recess having an indentation on which the outer portion rests, and which includes an elastomeric sealing ring provided between the outer portion and the indentation.

* * * * *